United States Patent [19]

Nishioka

[11] Patent Number: 4,879,987

[45] **Date of Patent: * Nov. 14, 1989**

[54] SHOOTING BOW

[76] Inventor: Jim Z. Nishioka, 1268 Hemlock NW., Salem, Oreg. 97304

[ * ] Notice: The portion of the term of this patent subsequent to Aug. 30, 2005 has been disclaimed.

[21] Appl. No.: 193,153

[22] Filed: May 5, 1988

Related U.S. Application Data

[63] Continuation-in-part of Ser. No. 52,274, May 21, 1987, abandoned, which is a continuation-in-part of Ser. No. 918,074, Oct. 14, 1986, abandoned.

[51] Int. Cl.[4] ..... F41B 5/00

[52] U.S. Cl. ..... 124/25; 124/DIG. 1

[58] Field of Search ..... 124/23 R, 24 R, 25, 124/88, 22, DIG. 1

[56] References Cited

U.S. PATENT DOCUMENTS

| | | | |
|---|---|---|---|
| 3,108,583 | 10/1963 | Andis | 124/25 |
| 3,224,427 | 12/1965 | Ronan | 124/25 |
| 3,242,917 | 3/1966 | Benedict | 124/25 |
| 3,483,857 | 12/1969 | Jones | 124/25 |
| 4,178,904 | 12/1979 | Meininger | 124/23 R |
| 4,261,321 | 4/1981 | Nishioka | 124/25 |
| 4,649,891 | 3/1987 | Bozek | 124/25 |
| 4,766,874 | 8/1988 | Nishioka | 124/25 |

OTHER PUBLICATIONS

Barnett, Advertisement on p. 25 of Apr. 1985, "Bow & Arrow" magazine, copy avail. in PTO 124/25.

*Primary Examiner*—Edward M. Coven
*Assistant Examiner*—Mark S. Graham

[57] ABSTRACT

A shooting bow includes a elongated frame, a bowstring, a pair of arms for providing tension in the bowstring and a pair of rotatable bowstring guide members on the arm tip ends, respectively. The bowstring includes a main span extending between the guide members. The bow also includes a bowstring catch and trigger mechanism positioned on the frame for holding the bowstring in a drawn position and for releasing it to propel a projectile. Each of the arms includes a rigid portion and a flexible portion, respectively. The rigid portions of the arms extend forwardly and are positioned on opposite sides of the frame. A cam is positioned on the lateral center of the frame.

8 Claims, 1 Drawing Sheet

SHOOTING BOW

This is a continuation in part of application Ser. No. 052,274 filed May 21, 1987 now abandoned, which is a continuation-in-part of Ser. No. 918,074 filed 10/14/86 now abandoned.

A Terminal Disclaimer referring to the applicant's U.S. Pat. No. 4,766,874 has been filed.

FIELD OF THE INVENTION

This invention relates to new and useful improvements in shooting bows.

SUMMARY OF THE INVENTION

According to the present invention and forming a primary objective thereof, a shooting bow is provided which is of the type employing tension provided by a pair of arms. The arms extend in a forwardly direction and are positioned on opposite sides of the frame, respectively.

A U.S. Pat. No. 3,108,583 shows a projectile launcher which employs elastic slings positioned on the stock. The stock extends forwardly beyond the bowstring. The portion of the stock which extends in front of the bowstring is necessary to support and position the elastic slings so that the launcher can function as intended. However, such portion of the stock in front of the bowstring increases a front to back profile of the launcher. In one embodiment of the launcher, a pair of forwardly extending arms is employed to supplement the tension provided by the elastic slings. The butt portions of the arms are mounted transversely to the frame so the arms must curve in a forwardly direction to properly position the bowstring. The device also employs a cup attached to the elastic slings and the bowstring. An arrow engaged to the cup is shown in another embodiment. However, this embodiment does not employ the forwardly extending arms or the bowstring but employs only elastic slings to provide tension to propel the arrow.

An objective of the present invention is to provide a simple concept of bow construction to reduce parts and manufacturing costs.

Another objective of this invention is to provide a bow which moves less parts during shooting movements to provide more speed potential.

Still another objective of the present invention is to provide a bow with a frame which terminates adjacent to the bowstring main span to provide a compact front to back profile.

The invention will be better understood and additional objectives and advantages thereof will become apparent from the following description taken in connection with the accompanying drawings.

DETAILED DESCRIPTION OF PREFERRED EMBODIMENTS

Figure 1:
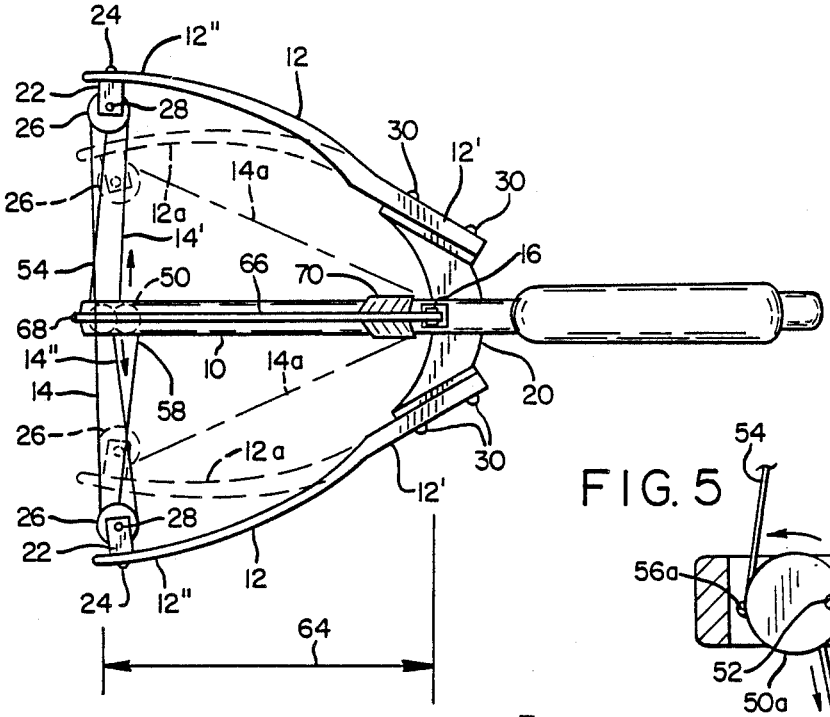
FIG. 1 is an overhead view of the shooting bow embodying principles of the present invention.
Figure 5:
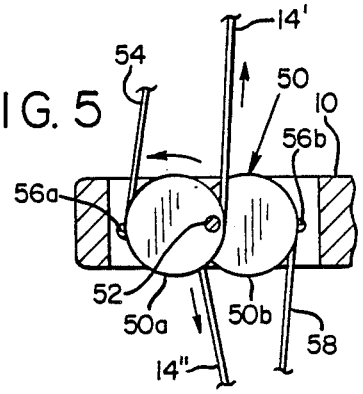
FIG. 5 is an enlarged overhead view of a cam for the bow.
Figure 2:
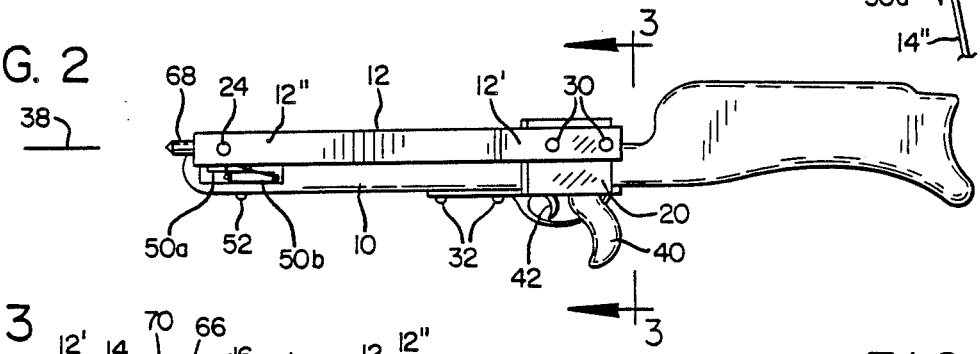
FIG. 2 is a side elevational view of the bow.
Figure 3:
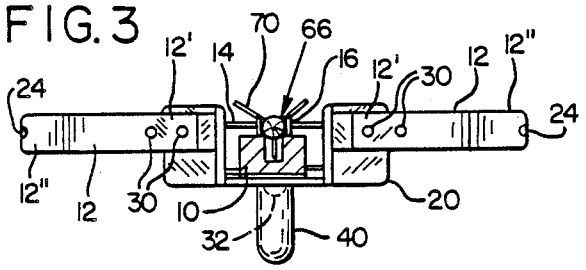
FIG. 3 is a sectional view taken on line 3—3 of FIG. 2.
Figure 6:
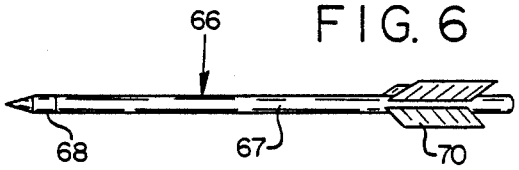
FIG. 6 is a side elevational view of a conventional arrow.
Figure 4:
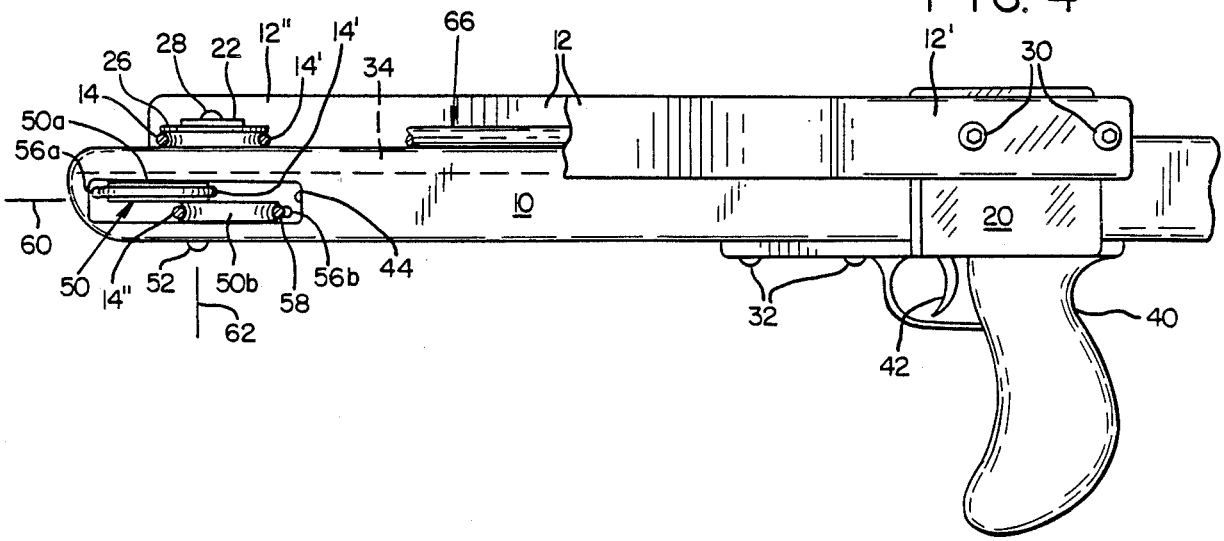
FIG. 4 is an enlarged fragmentary view of a forward portion of the bow with one of the arms and arrow broken away.

With reference to the drawings, which show a preferred embodiment of the present invention, the shooting bow includes a frame 10 and a pair of arms 12. Each of the arms includes a rigid butt portion 12' and a flexible portion 12'', respectively. The bow also includes a bowstring 14 extending between the arms, a bowstring catch 16, and a support 20 which supports the arms on the frame. A pair of brackets 22 are secured by bolts 24 to the tip ends of the respective arms 12. A pair of pulleys 26 are rotatably supported on the brackets 22 by a pair of shafts 28.

The pulleys 26 guide the bowstring 14, such bowstring including a main span extending between the pulleys and a pair of end spans 14' and 14'' extending from the pulleys. The arms 12 are secured to the support 20 by bolts 30 and the support is secured to the frame 10 by bolts 32.

The frame 10 includes a projectile track 34 for guiding an arrow or a projectile to be shot by the bow. A lateral center of the bow is indicated by a line 36 and a horizontal plane of a bowstring movement is indicated by a line 38.

A drawn position of the bowstring 14 engaged to the bowstring catch 16 is indicated by a broken line **14*a* and a drawn position of the arms is indicated by a broken line 12*a*. The bow also includes a hand grip 40 and a trigger 42**.

The bow includes a rest condition and a drawn condition. The rest condition of the bow is before a draw force is applied to the bowstring main span 14 and the drawn condition of the bow is when the bowstring is drawn rearwardly and engaged to the bowstring catch 16.

The elongated frame 10 terminates adjacent to the position of the bowstring main span 14 when the bow is in the rest condition. This is a very important feature of the invention which reduces the front to back profile of the bow compared to prior structures. Such compact front to back profile of the present bow provides ease of handling and storage. Such design concept also simplifies manufacturing and reduces production costs. This concept is believed to be novel and not found in the prior art.

The bowstring end spans 14' and 14'' extend inwardly from the pulleys 26 to the forward portion of the elongated frame 10. This also is believed to be a novel feature.

An opening 44 through a forward end portion of the frame 10 accommodates a cam 50 which controls a tension in the bowstring 14. The cam provides a let-off of the tension required to draw the bowstring during end drawing movements of the bow. The cam is positioned in the lateral center of the frame and is pivotably supported by a shaft 52. The cam comprises a top portion **50*a* and a bottom portion 50*b*. The bowstring end span 14' wraps around the top portion 50*a* and is anchored by a pin 56*a* to such top portion. An extension of the bowstring 54 extends from the top portion 50*a* to the bow arm flexible portion 12''. The bottom portion 50*b* is similarly attached to the bowstring and the bow arm. The bowstring end span 14'' wraps around the bottom portion 50*b* and is anchored by a pin 56*b*. An extension of the bowstring 58** extends from the bottom portion 50*b* to the bow arm flexible portion 12″. The top and the bottom portions of the cam are secured together and pivot together and in unison.

A horizontal plane of a pivoting movement of the cam 50 is indicated by a line 60. A front to back center of the cam is indicated by a line 62. The cam pivots in a counterclockwise direction when a draw force is applied to the bowstring main span 14. The shaft 52 is positioned substantially perpendicularly to the frame 10. Such shaft also is positioned in the lateral center of the frame and extends upwardly through the bottom of the frame into the opening 44 in such frame. The cam is positioned between the flexible portions 12″ of the forwardly extending arms 12.

The arms 12 include a first arm positioned on one side of the frame 10 and a second arm positioned on the opposite side of the frame. The rigid butt portions 12′ of the arms extend in a forwardly direction towards the bowstring main span 14. This is believed to a novel and useful feature. Such positioning of the rigid butt portions of the arms eliminates the need to curve the arms from a transverse direction to a forward direction. A prior structure employs butt portions of arms which are mounted transversely to the frame. These arms must be curved from such transverse direction to a forward direction which increases the complexity and cost of the arms.

Still furthermore, the mounting of the pair of forwardly extending arms 12 on opposite sides of the frame, respectively, distributes the stress over a larger area of the arms during drawing and shooting movements.

A conventional arrow 66 is positioned on the track 34 and such arrow includes a shaft 67, a head 68 and fletchings 70. The arrow is shown in a loaded position in FIG. 1. It is customary to first draw the bowstring main span 14 and engage it to the bowstring catch 16 before loading the arrow, however, for illustration purposes, the arrow is shown in the loaded position prior to drawing the bowstring. If desired, the bowstring main span could be drawn over the top of the arrow and engaged to the bowstring catch.

The power stroke for the bow of this invention is indicated by a line and arrows 64. The power stroke is the length of the arrow propelling movement of the bowstring main span 14. In a rest condition of the bow the bowstring main span is positioned adjacent to the forward end of the frame 10, therefore, the power stroke of this bow commences adjacent to such forward end of the frame. This is believed to be an important novel feature of the invention which is not found in the prior art.

The support 20 provides hand clearance along the frame 10 for drawing the bowstring main span 14 back to the bowstring catch 16 when cocking the bow. The support also positions the arms 12 so that each of the arms angles away from the horizontal center line 36 of the bow in a forwardly direction. The support is positioned transversely to the elongated frame and extends under and to each side of such frame. The arms may be connected directly to the frame or other devices may be employed to accomplish the same function as the support.

The preferred construction of the support 20 is shown in FIG. 1, however, the support may be positioned more forwardly on the frame 10. The support may be constructed to extend rearwardly to properly position the arms 12.

Simple pulleys 26 for guiding the bowstring 14 are shown on the tip ends of the arms 12, however, other devices such as rotatable cams may be employed to guide the bowstring. Such cams, similar to the pulleys 26, would be positioned between the flexible portions 12″ of the arms and also be laterally aligned with such flexible portions.

The cam 50 may be modified by constructing the top and bottom portions 50*a* and 50*b* larger or smaller to increase or decrease the draw length of the bowstring. Furthermore, various shapes and styles of cams may be employed, such as stepped construction, to control bowstring travel and the flexing of the arms 12. Still furthermore, the bowstring catch 16 may be positioned more forwardly or more rearwardly on the frame 10 to decrease of increase the bowstring travel.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. A shooting bow comprising
an elongated frame portion,
a bowstring,
bowstring tension means on said frame operatively connected to said bowstring for providing tension in said bowstring,
a pair of rotatable bowstring guide members on said tension means,
said bowstring including a main span extending between said guide members and a pair of end spans extending from said guide members,
a bowstring catch and trigger mechanism on said frame portion for holding said bowstring in a drawn position and for releasing it to propel an arrow or projectile,
said tension means comprising a pair of arms,
each of said arms including a rigid butt portion and a flexible portion, respectively,
said bow also including means connected to said bowstring for providing a let-off of draw force required during end drawing movements of the bowstring, said means controlling bowstring travel and tension, said means being positioned on said frame portion of said bow,
said means for providing a let-off for the bowstring including a cam pivotably supported on said elongated frame portion,
said frame portion including a lateral center, said cam being positioned in said lateral center of said frame portion.

2. The shooting bow of claim 1 wherein both of the bowstring end spans extend to the cam in the lateral center of the frame.

3. The shooting bow of claim 2 wherein said cam includes a first and a second bowstring groove for receiving the pair of bowstring end spans, respectively,
said grooves secured together and supported by a shaft so that when a draw force is applied to the bowstring main span the grooves will pivot together and in unison in the lateral center of the frame.

4. A shooting bow comprising
an elongated frame, said frame including a forward end,
a bowstring, bowstring tension means on the frame operatively connected to said bowstring for providing tension in said bowstring, a pair of rotatable bowstring guide members on said tension means, said bowstring including a main span extending between said guide members and a pair of end spans extending from said guide members, a bowstring catch and trigger mechanism on said frame for holding said bowstring in a drawn position and for releasing it to propel an arrow or projectile, said tension means comprising a pair of forwardly extending arms, each of said arms including a forwardly extending rigid butt portion and a forwardly extending flexible portion, respectively, said rigid butt portions being elongated members integrally connected to the flexible portions, respectively, said elongated frame including opposite longitudinal sides, said (first and second) pair of arms being positioned on the opposite sides of the frame, respectively, (said bow including support means attached to the frame for supporting said forwardly extending elongated member butt portions,)

said forwardly extending elongated member butt portions being operatively secured to said (support means,) elongated frame rearwardly of the forward end of the frame, (said support means being positioned rearwardly of the forward end of the frame,)

said bow including first and second positioning means for positioning said pair of butt portions, respectively, said first and second positioning means being operatively connected to the frame rearwardly of the forward end of the frame, said first and second positioning means also being positioned on the opposite sides of the frame, respectively, said first and second positioning means being operatively connected to said pair of butt portions, respectively, said first and second positioning means positioning said pair of butt portions so that they extend forwardly and angle away from the opposite sides of the frame, respectively.

5. The shooting bow of claim 4 wherein said first and second positioning means are operatively connected to the frame adjacent to said bowstring catch and trigger mechanism.

6. A shooting bow for use with a projectile, said shooting bow comprising an elongated frame, said frame including a forward end portion, a bowstring, a pair of forwardly extending arms, each of said arms including a forwardly extending rigid butt portion and a forwardly extending flexible portion, respectively, said rigid butt portions being elongated members integrally connected to the flexible portions, respectively, a pair of rotatable bowstring guide members on said pair of forwardly extending flexible portions of said arms, respectively, said bowstring including a main span extending between said rotatable guide members and a pair of end spans extending from said rotatable guide members, a bowstring catch and trigger mechanism on said frame for holding said bowstring in a drawn position and for releasing it to propel the projectile, said bow including a rest condition before a draw force is applied to the bowstring and a drawn condition when the bowstring main span is drawn and engaged to said bowstring catch, said rotatable bowstring guide members positioning said bowstring main span adjacent to said forward end portion of the frame when the bow is in the rest condition, said bowstring main span and the projectile being connected directly to said bowstring catch when the bow is in the drawn condition and loaded, said pair of elongated butt portions of said arms each including a forward portion and a rearward end portion, respectively, said pair of rearward end portions extending forwardly in a shooting direction of said bow.

7. The shooting bow of claim 6 wherein said bowstring catch and trigger mechanism is positioned between said forwardly extending elongated butt portions.

8. In combination, a shooting bow and means to connect a pair of arms to said bow, said shooting bow including an elongated frame extending longitudinally in a shooting direction of said bow, said frame including longitudinal opposite sides, a bowstring including a main span, said pair of arms being flexible for providing tension for said main span, said arms each including a flexible portion and a rigid butt portion, respectively, each of said arms including a tip end, respectively, said main span being positioned between said tip ends, said means operatively connecting said pair of flexible arms to said frame on said opposite sides of said frame, respectively, said flexible portion and said rigid butt portion of each of said arms extending in a common direction, said means positioning said arms so that said flexible portion and said rigid butt portion of each of said arms extend in a forwardly direction.

* * * * *